US007240508B2

(12) United States Patent
Park

(10) Patent No.: US 7,240,508 B2
(45) Date of Patent: Jul. 10, 2007

(54) CONNECTING PACKAGE FOR REFRIGERATOR COMPRESSOR

(75) Inventor: Young-Hwan Park, CheongJu (KR)

(73) Assignee: Sensata Technologies, Inc., Attleboro, MA (US)

( * ) Notice: Subject to any disclaimer, the term of this patent is extended or adjusted under 35 U.S.C. 154(b) by 195 days.

(21) Appl. No.: 11/179,142

(22) Filed: Jul. 12, 2005

(65) Prior Publication Data

US 2006/0101841 A1 May 18, 2006

(30) Foreign Application Priority Data

Nov. 16, 2004 (KR) ..... 10-2004-0093421

(51) Int. Cl.
*F25D 19/00* (2006.01)

(52) U.S. Cl. ..... 62/298

(58) Field of Classification Search ..... 62/298, 62/508; 361/22, 24, 27

See application file for complete search history.

(56) References Cited

U.S. PATENT DOCUMENTS 4,646,824 A * 3/1987 Huang et al. ..... 166/52
4,701,824 A * 10/1987 Beggs et al. ..... 361/24
4,862,306 A * 8/1989 Lisauskas ..... 361/24
5,170,307 A 12/1992 Nacewicz et al.
6,317,304 B1 11/2001 De Campos
6,548,924 B2 4/2003 Furukawa et al.
6,795,283 B2 9/2004 Lisauskas et al.

* cited by examiner

*Primary Examiner*—Melvin Jones
(74) *Attorney, Agent, or Firm*—Russell E. Baumann

(57) ABSTRACT

Disclosed is a connecting package for a refrigerator compressor. The connecting package includes a base including an overload protector mounting section and a motor starter relay element mounting section and having first to third pin connecting ports connected to a compressor motor through a circular terminal of a compressor body, a cover detachably coupled to an upper portion of the base, including a dome-shaped overload protector mounting section and a dome-shaped motor starter relay element mounting section corresponding to the overload protector mounting section and the motor starter relay element mounting section of the base, and having a plurality of slots for connecting terminals formed around the dome-shaped overload protector mounting section and the dome-shaped motor starter relay element mounting section, a motor starter relay element mounted on the motor starter relay element mounting sections of the base and the cover and having first and second pin connectors positioned corresponding to the first and second pin connecting ports of the base, and a low-power overload protector mounted on the overload protector mounting sections of the base and the cover and having a first connecting terminal connected to a pin connector positioned corresponding to the third pin connecting port of the base, a second connecting terminal connected to a quick connector connected to an external power source, and a heating element for shortening a reaction time of the low-power overload protector.

28 Claims, 15 Drawing Sheets

CONNECTING PACKAGE FOR REFRIGERATOR COMPRESSOR

BACKGROUND OF THE INVENTION

1. Field of the Invention

The present invention relates generally to a connecting package for a refrigerator compressor, and more particularly to connecting package for a refrigerator compressor, which can be directly mounted on a body of a refrigerator compressor in a state that a motor starter relay element and a low-power motor overload protector are mounted therein.

2. Description of the Related Art

Generally, a connecting package for a refrigerator compressor is equipped with a PTC (positive temperature coefficient) starter relay element for starting an AC motor used with the refrigerator compressor. Besides the PTC starter relay element, an overload protector for protecting a motor from overload and/or a running capacitor (RC) for improving an efficiency of the motor can be provided in the connecting package.

However, when installing the connecting package to the refrigerator compressor, the starter relay element, the overload protector, and the running capacitor, if necessary, must be individually wired with each other. For this reason, connecting wires and mounting brackets must be provided at an outer portion of the refrigerator compressor. Therefore, not only is a structure of a product complicated, but also maintenance and repair works are difficult while causing an assembling error, thereby lowering quality and productivity of products.

In addition, when coupling the connecting package to a circular terminal part provided on the body of the refrigerator compressor from an exterior, moisture including water or rainwater may be easily introduced into a gap formed between the connecting package and the circular terminal part, so that an electrical connection between the connecting package and the circular terminal part becomes unstable. In addition, when a connecting terminal protruding out of the connecting package is connected with an external terminal, the connecting terminal may be over-pressed or bent due to external load applied thereto.

Accordingly, it is necessary to provide a connecting package for a refrigerator compressor, in which an electric connection for various elements is easily achieved through a single package in such a manner that a motor can be protected from overload when an operation of the refrigerator compressor starts while improving an operating efficiency of the motor, moisture including water or rainwater can be prevented from penetrating into a connection part when the connecting package is coupled with the refrigerator compressor while reducing the influence of load generated when coupling the connecting package with the refrigerator compressor, and the connecting package can be stably connected to a body of the refrigerator compressor, thereby stably operating the refrigerator compressor.

SUMMARY OF THE INVENTION

The present invention is directed to a connecting package for a refrigerator compressor that substantially obviates one or more problems due to limitations and disadvantages of the related art.

It is an object of the present invention to provide a connecting package for a refrigerator compressor, in which an electric connection for various elements is easily achieved through a single package in such a manner that a motor can be protected from overload when an operation of the refrigerator compressor starts while improving an operating efficiency of the motor, moisture including water or rainwater can be prevented from penetrating into a connection part when the connecting package is coupled with the refrigerator compressor while reducing an influence of load generated when coupling the connecting package with the refrigerator compressor, and the connecting package can be stably connected to a body of the refrigerator compressor, thereby stably operating the refrigerator compressor.

Additional advantages, objects, and features of the invention will be set forth in part in the description which follows and in part will become apparent to those having ordinary skill in the art upon examination of the following or may be learned by practicing the invention. The objectives and other advantages of the invention may be realized and attained by the structure particularly pointed out in the written description and claims hereof as well as the appended drawings.

To achieve these objects and other advantages in accordance with the purpose of the invention, as embodied and broadly described herein, there is provided a connecting package for a refrigerator compressor, the connecting package comprising: a base including an overload protector mounting section and a motor starter relay element mounting section and having first to third pin connecting ports connected to a compressor motor through a circular terminal of a compressor body; a cover detachably coupled to an upper portion of the base, including a dome-shaped overload protector mounting section and a dome-shaped motor starter relay element mounting section corresponding to the overload protector mounting section and the motor starter relay element mounting section of the base, and having a plurality of slots for connecting terminals formed around the dome-shaped overload protector mounting section and the dome-shaped motor starter relay element mounting section; a motor starter relay element mounted in the motor starter relay element mounting sections of the base and the cover and having first and second pin connectors positioned corresponding to the first and second pin connecting ports of the base; and a low-power overload protector mounted in the overload protector mounting sections of the base and the cover and having a first connecting terminal connected to a pin connector positioned corresponding to the third pin connecting port of the base, a second connecting terminal connected to a quick connector connected to an external power source, and a heating element for shortening a reaction time of the low-power overload protector.

According to the preferred embodiment of the present invention, the cover is provided at both sides thereof with a downward extension section having a coupling protrusion, and the base is formed at both sides thereof with a coupling slot detachably coupled with the coupling protrusion of the cover such that the base is detachably coupled to the cover.

According to the preferred embodiment of the present invention, protective guides are aligned around the slots of the cover so as to protect the connecting terminals protruding through the slots.

According to the preferred embodiment of the present invention, a circular terminal shielding cover is formed at a lower portion of the base in order to protect the circular terminal formed on the body of the refrigerator compressor when the connecting package is connected to the circular terminal formed on the body of the refrigerator compressor.

According to the preferred embodiment of the present invention, a downward extension section is integrally formed with an outer surface of the cover so as to detachably couple the connecting package to the compressor body.

According to the preferred embodiment of the present invention, one of the first and second pin connectors of the motor starter relay element and another pin connector connected to the first connecting terminal of the overload protector are connected to a main winding section of a motor, the other one of the first and second pin connectors of the motor starter relay element is connected to an auxiliary winding section of the motor, and one of the first and second pin connectors connected to the main winding section of the motor is provided with a connecting terminal connected to an external power source through the slots formed in the cover.

According to the preferred embodiment of the present invention, the low-power overload protector includes a conductive housing can having a bottom section, lateral sections, a flange extending from the lateral sections and a connecting terminal extending from one end of the conductive housing can; a bimetal member having a first end fixed to the bottom section of the conductive housing can and a second end provided with a movable contact; an insulation gasket having a wing cover surrounding the flange of the conductive housing can and an opening window which is a moving path for the bimetal member; a plate having first and second sections separated from each other and including a fixing contact, a connecting terminal provided at one end of the plate, and clamp wings provided at both sides of the plate in order to fix the flange of the conductive housing can and the wing cover of the insulation gasket together; and a coil heater having first and second ends fixed to first and second sections of the plate, respectively, serving as the heating element.

According to the preferred embodiment of the present invention, the low-power overload protector includes a conductive housing can having a bottom section, lateral sections, a flange extending from the lateral sections and a connecting terminal extending from one end of the conductive housing can; a bimetal member having a first end fixed to the bottom section of the conductive housing can and a second end provided with a movable contact; an insulation gasket having a wing cover surrounding the flange of the conductive housing can and an opening window which is a moving path for the bimetal member; a plate having first and second sections separated from each other and including first and second protruded ledge sections provided in the first and second sections while forming a central hole therebetween, a fixing contact, a connecting terminal provided at one end of the plate, and clamp wings provided at both sides of the plate in order to fix the flange of the conductive housing can and the wing cover of the insulation gasket together; a ceramic plate heater element accommodated in a recess defined by the first and second ledge sections, serving as the heating element and having a ceramic substrate, electric contact sections provided at both sides of the ceramic plate heater element such that electric contact sections make contact with the ledge sections and an electric-heating film formed between the electric contact sections; and a clamp spring including a longitudinal extension portion for supporting the ceramic plate heater element and a transverse extension portion provided at both sides thereof with a clamp bending section fixed on the clamp wing of the plate.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to an optical film, a manufacturing method thereof, and a backlight unit for a liquid crystal display using the same according to the preferred embodiment of the present invention, examples of which are illustrated in the accompanying drawings. Wherever possible, the same reference numbers will be used throughout the drawings to refer to the same or like parts.

Figure 1A:
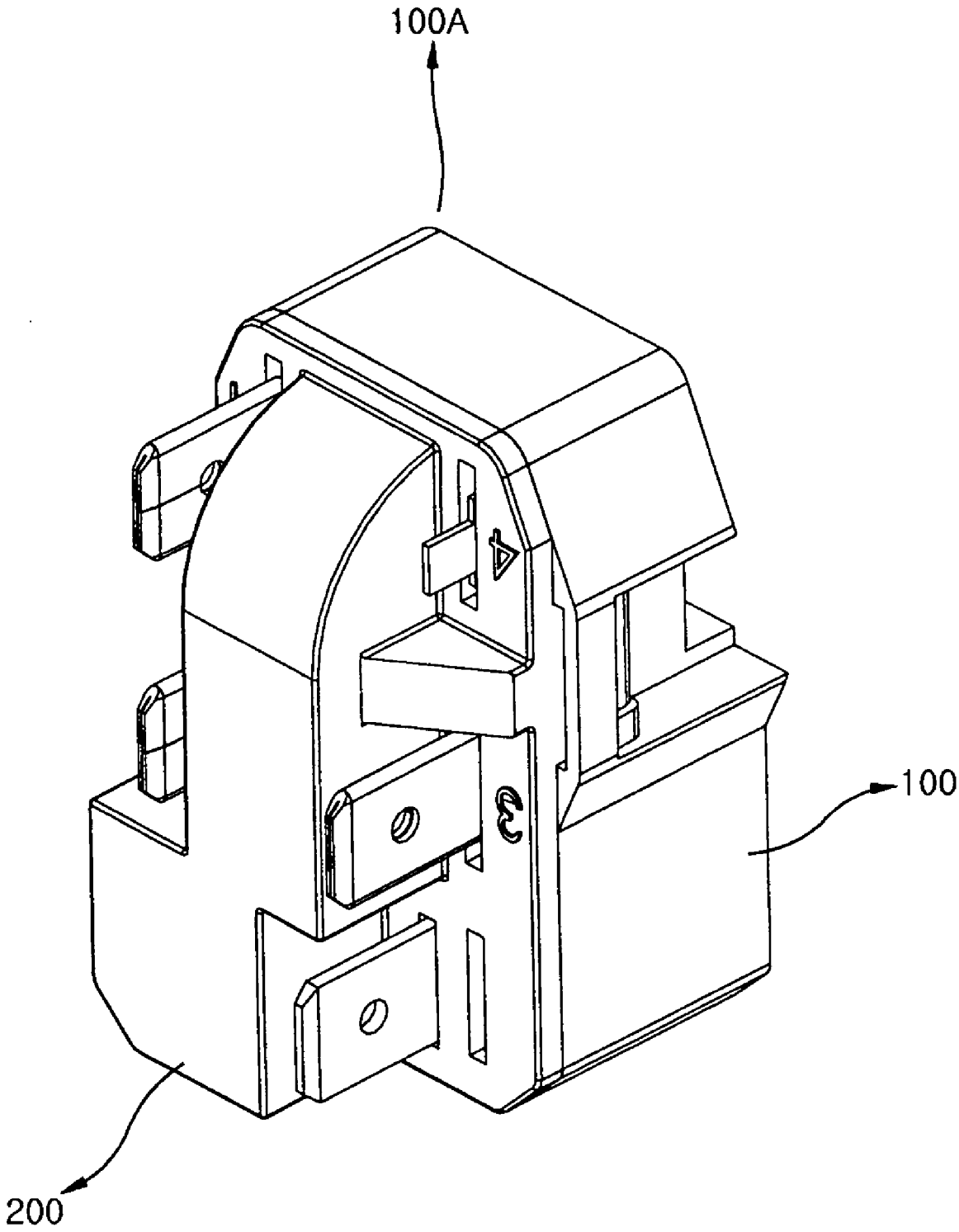
FIG. 1*a* is a perspective view of a connecting package for a refrigerator compressor according to one embodiment of the present invention.
Figure 1B:
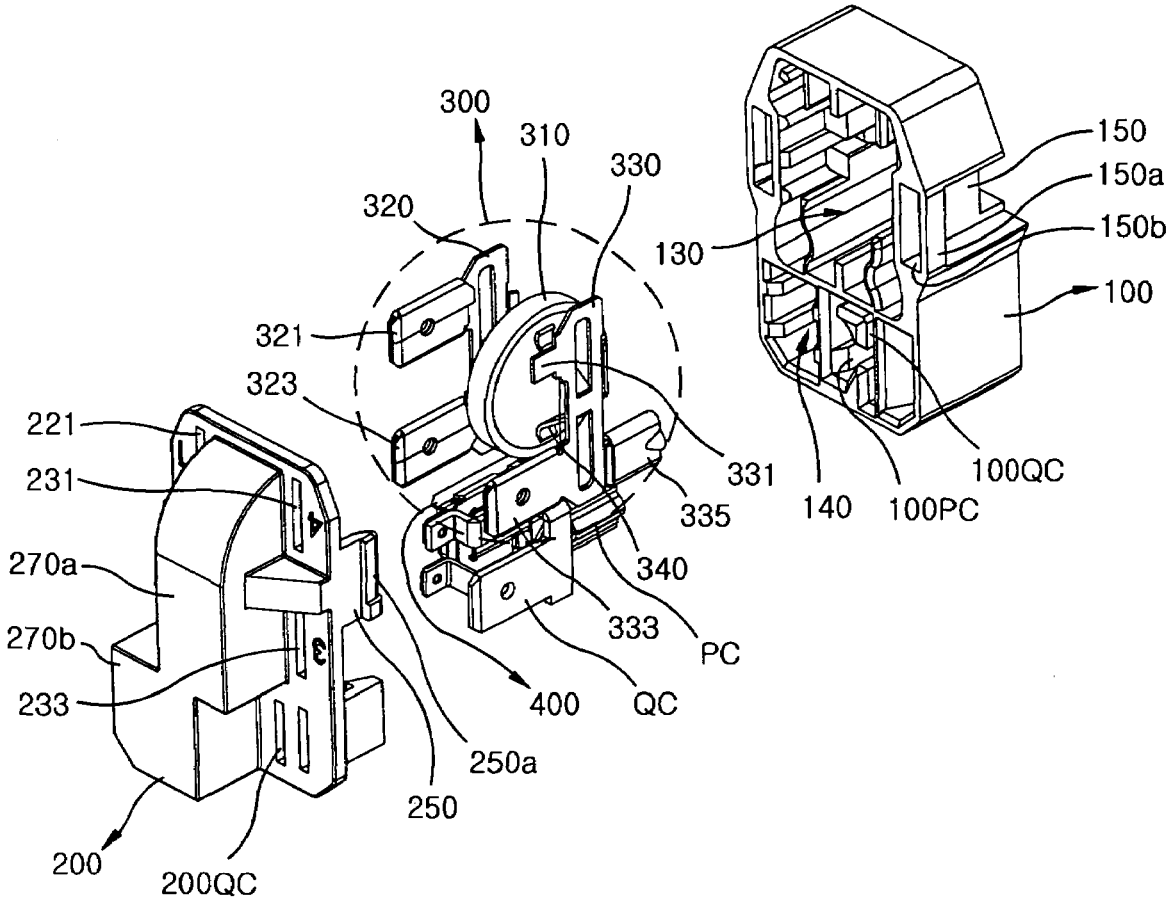
FIG. 1*b* is an exploded perspective view of a connecting package for a refrigerator compressor shown in FIG. 1*a*.
Figure 1C:
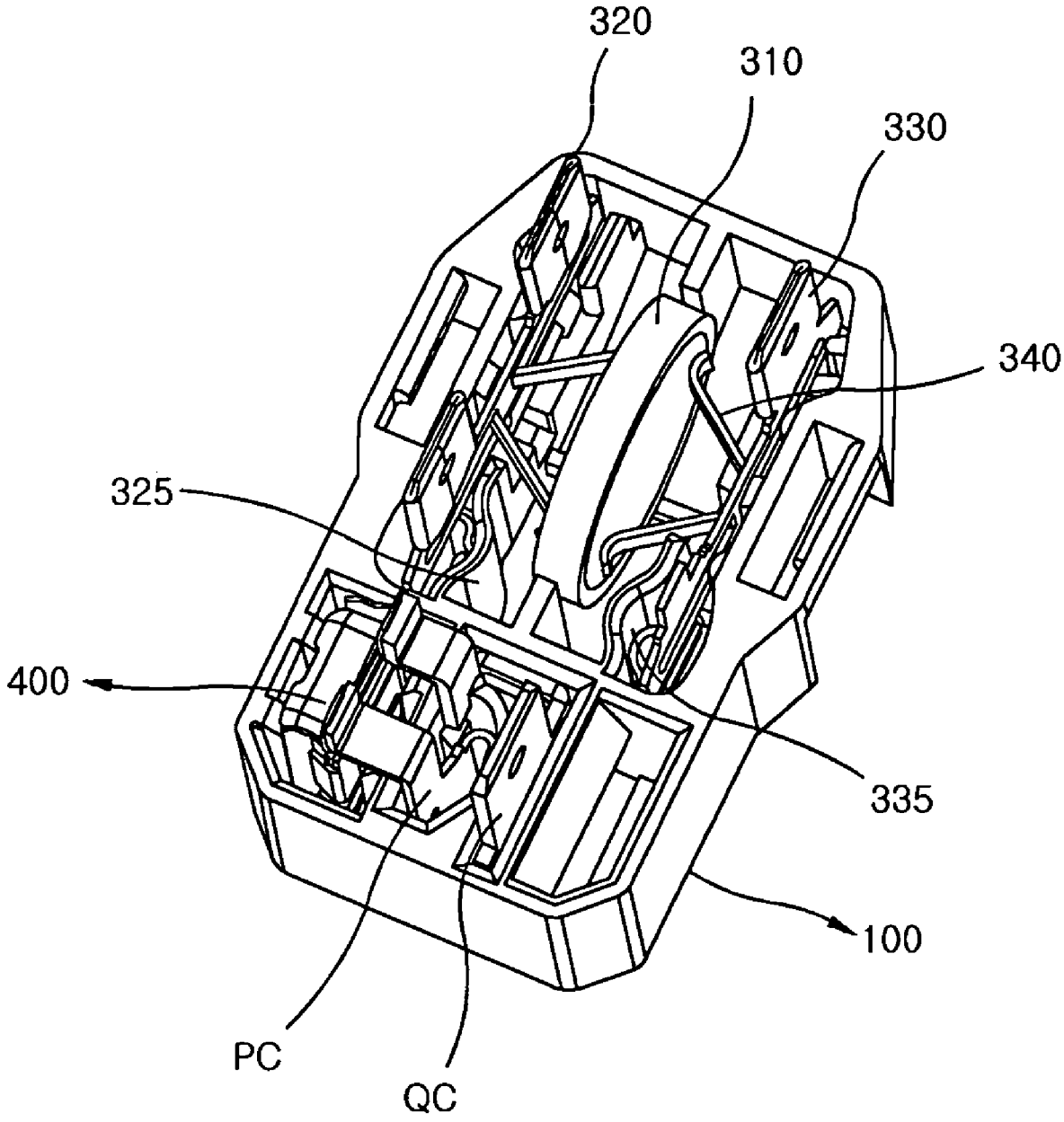
FIGS. 1*c* and 1*d* are perspective and plan views of a connecting package shown in FIG. 1*b*, in which a motor starter relay element, an overload protector and connecting terminals are installed in a base.
Figure 1D:
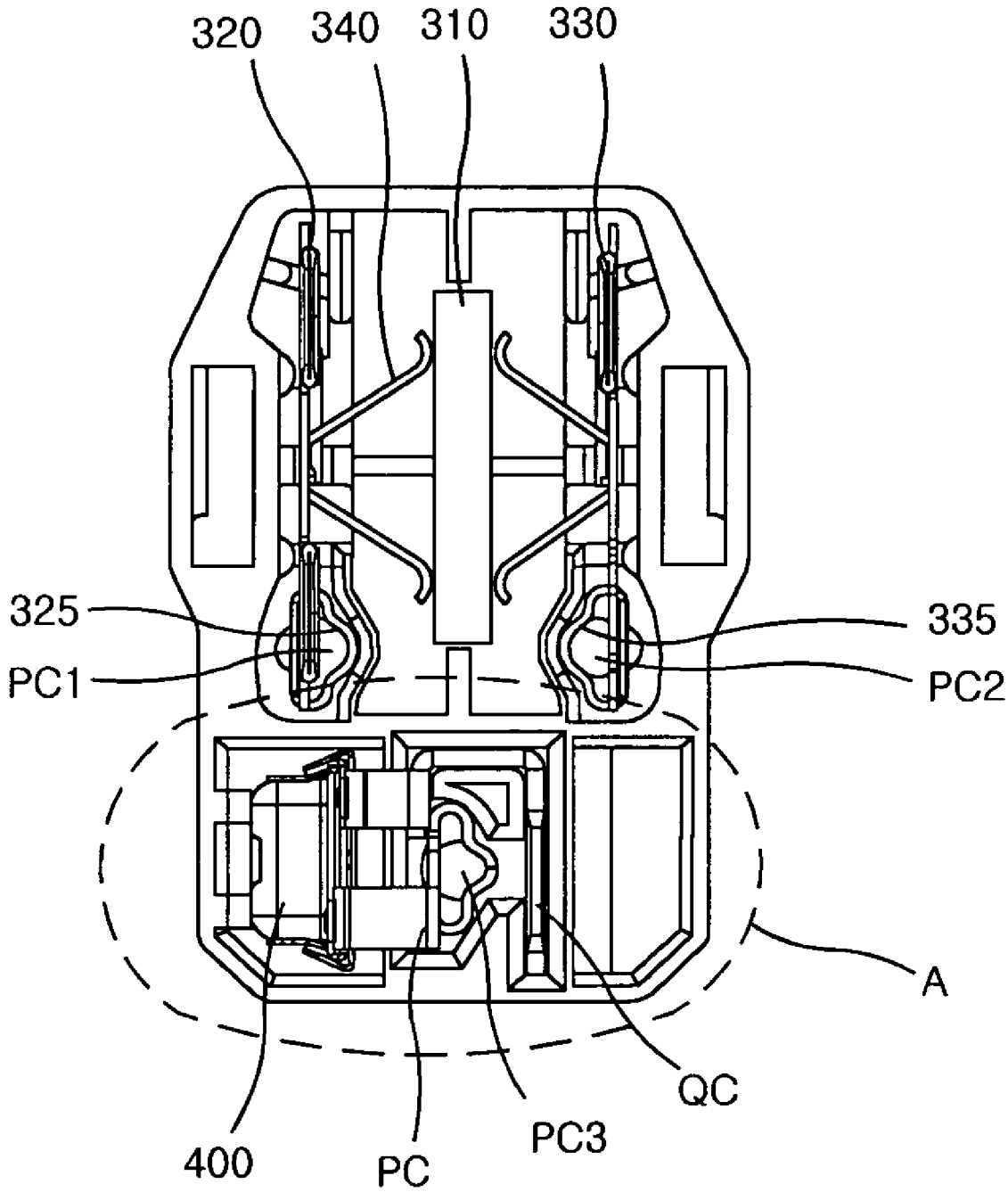
Figure 1E:
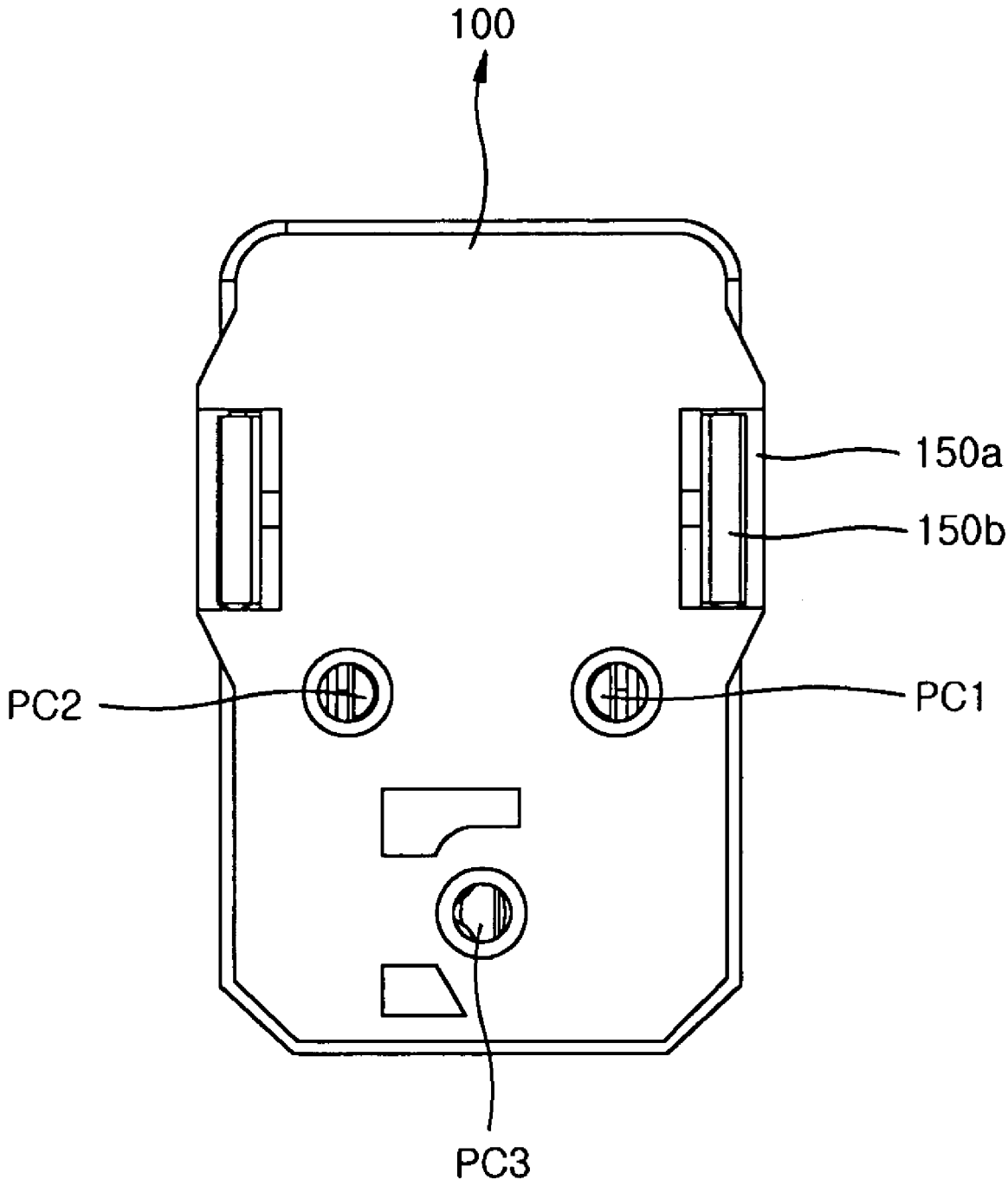
FIG. 1*e* is a bottom view of a base shown in FIG. 1*d*.

FIG. 1*a* is a perspective view of a connecting package 100A for a refrigerator compressor according to one embodiment of the present invention, FIG. 1*b* is an exploded perspective view of the connecting package 100A shown in FIG. 1*a*, FIGS. 1*c* and 1*d* are perspective and plan views of the connecting package 100A shown in FIG. 1*b*, in which a motor starter relay element, an overload protector and connecting terminals are installed on a base, and FIG. 1*e* is a bottom view of the base shown in FIG. 1*d*.

Referring to FIGS. 1*a* to 1*e*, the connecting package 100A for the refrigerator compressor according to one embodiment of the present invention includes a base 100 having first to third pin connecting ports PC1 to PC3 connected to a compressor motor through a circular terminal (not shown) provided on a compressor body, a cover 200 detachably coupled to an upper portion of the base 100, a motor starter relay element 300 having first and second pin connectors 325 and 335 positioned corresponding to the first and second pin connecting ports PC1 and PC2 of the base 100 and a PTC (positive temperature coefficient) starter element 310, and a low-power overload protector 400 having a heating element for shortening a reaction time of the low-power overload protector 400.

The base 100 includes an overload protector mounting section 140 for mounting the overload protector 400 and a motor starter relay element mounting section 130. In addition, the base 100 has receiving sections 100QC and 100PC for receiving a quick connector QC and a pin connector PC connected to both connecting terminals of the overload protector 400.

A coupling slot 150*b* is formed at both sides of the base 100 for allowing the base 100 to be coupled to the cover 200. The coupling slot 150*b* is defined by a recess 150 formed at both sides of the base 100 and a support bar 150*a* connecting both sidewalls of the recess 150. A coupling protrusion 250*a* formed at an end of a downward extension portion 250 of the cover 200 is inserted into the coupling slot 150*b* so that the base 100 is coupled to the cover 200.

The cover 200 is provided with a dome-shaped overload protector mounting section 270*b* and a dome-shaped motor starter relay element mounting section 270*a* corresponding to the overload protector mounting section 140 and the motor starter relay element mounting section 130 of the base 100. A plurality of slots 221, 223, 231, 233 and 200QC for connecting terminals are formed around the dome-shaped overload protector mounting section 270*b* and the dome-shaped motor starter relay element mounting section 270*a*.

The motor starter relay element 300 and the overload protector 400 are installed in the motor starter relay element mounting sections 130 and 270*a* and the overload protector mounting sections 140 and 270*b* of the base 100 and the cover 200 when the base 100 is coupled to the cover 200.

The motor starter relay element 300 is provided to start an operation of a motor and includes a disc-shaped PTC starter element 310 installed at the recess formed at a center of the base 100, rectangular conductive plates 320 and 330 provided at both sides of the disc-shaped PTC starter element 310 in opposition to each other, and an elastic connecting member 340 having a U-shape. A free end of the elastic connecting member 340 elastically makes contact with the disc-shaped PTC starter element 310 and a closed end of the elastic connecting member 340 is fixed to the rectangular conductive plates 320 and 330 such that the rectangular conductive plates 320 and 330 are electrically connected to the disc-shaped PTC starter element 310.

The rectangular conductive plates 320 and 330 are provided with pin connectors 325 and 335, which are connected to a main winding section and an auxiliary winding section of the motor in parallel to each other, respectively. For instance, the pin connectors 325 and 335 are connected to a running capacitor (not shown) through a jumper. In addition, the rectangular conductive plates 320 and 330 include connecting terminals 321, 323, 331, and 333 for allowing the rectangular conductive plates 320 and 330 to be connected to external devices.

It is preferable that at least two ribs 140*a* are formed on one inner wall of the overload protector mounting section 140 of the base 100 so as to protect the overload protector 400 from a vibration or heat (refer to FIG. 1*b* and FIG. 1*c*).

It is preferable that ribs 130*a* are formed on an inner wall of the motor starter relay element mounting section 130 of the base 100 outwards in a radial direction of a PTC starter element 310 of the motor starter relay element 300 so as to support the PTC starter element 310 with the ribs 130*a* facing each other (refer to FIG. 1*c*).

Each of the first and second pin connectors 325 and 335 has a pin receptacle 325*a* and 335*a* for detachably fixing a corresponding pin to the pin receptacle 325*a* and 335*a* (refer to FIG. 1*c* and FIG. 1*d*).

The overload protector 400 mounted in the connecting package for the refrigerator compressor of the present invention is a low-power overload protector, in which a heater is accommodated. When overload is applied to the overload protector 400, the heater generates heat so that a temperature of the overload protector 400 rapidly reaches an operational temperature thereof, thereby reducing power consumption and achieving reliability and stability of the overload protector 400.

The connecting package according to the present invention may employ various overload protectors. One of such overload protectors is a coil heater type overload protector as shown in FIGS. 3*a* and 3*b*.

Figure 3A:
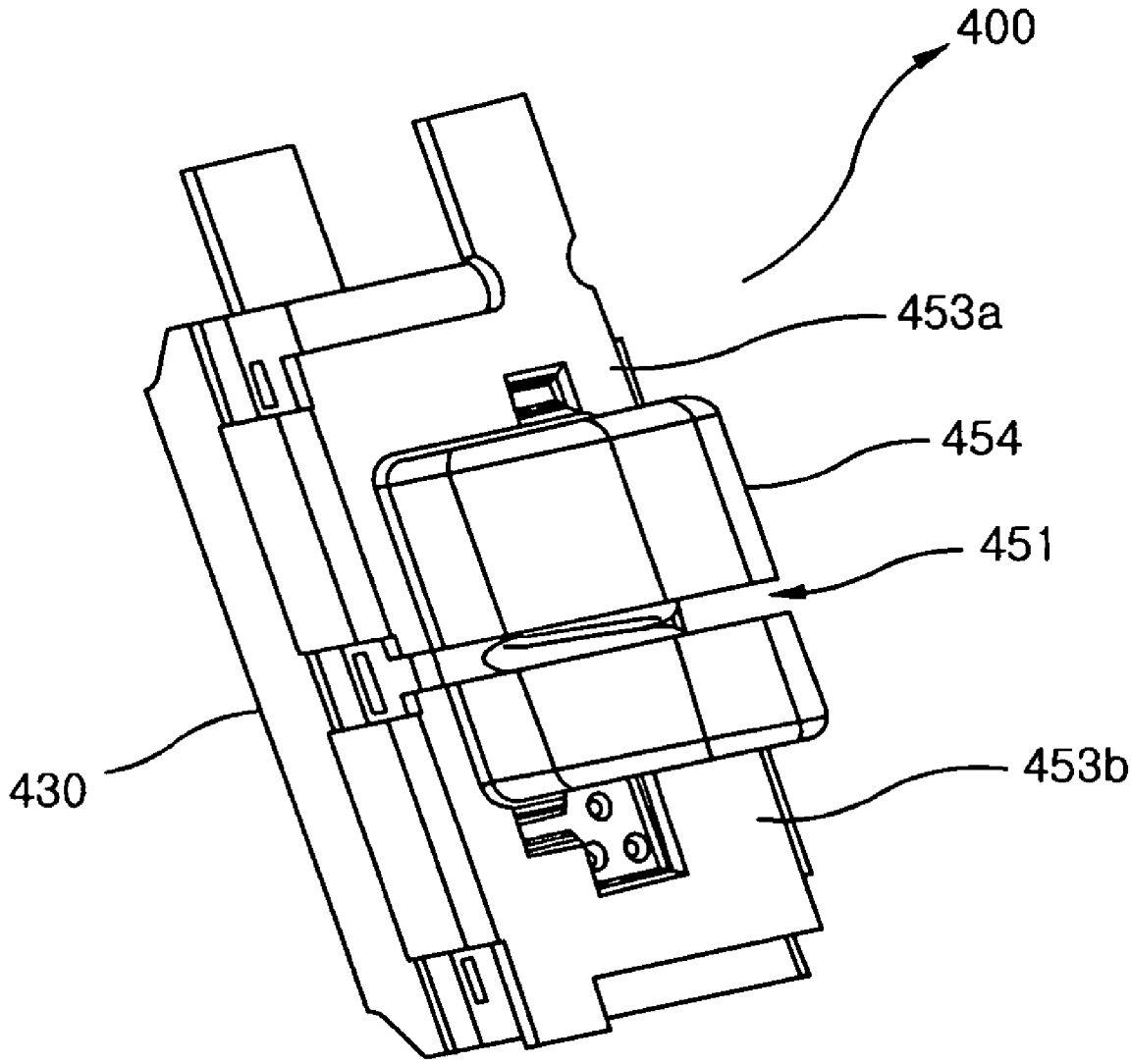
FIG. 3*a* is a perspective view of a coil heater type overload protector mounted in a connecting package for a refrigerator compressor according to one embodiment of the present invention.
Figure 3B:
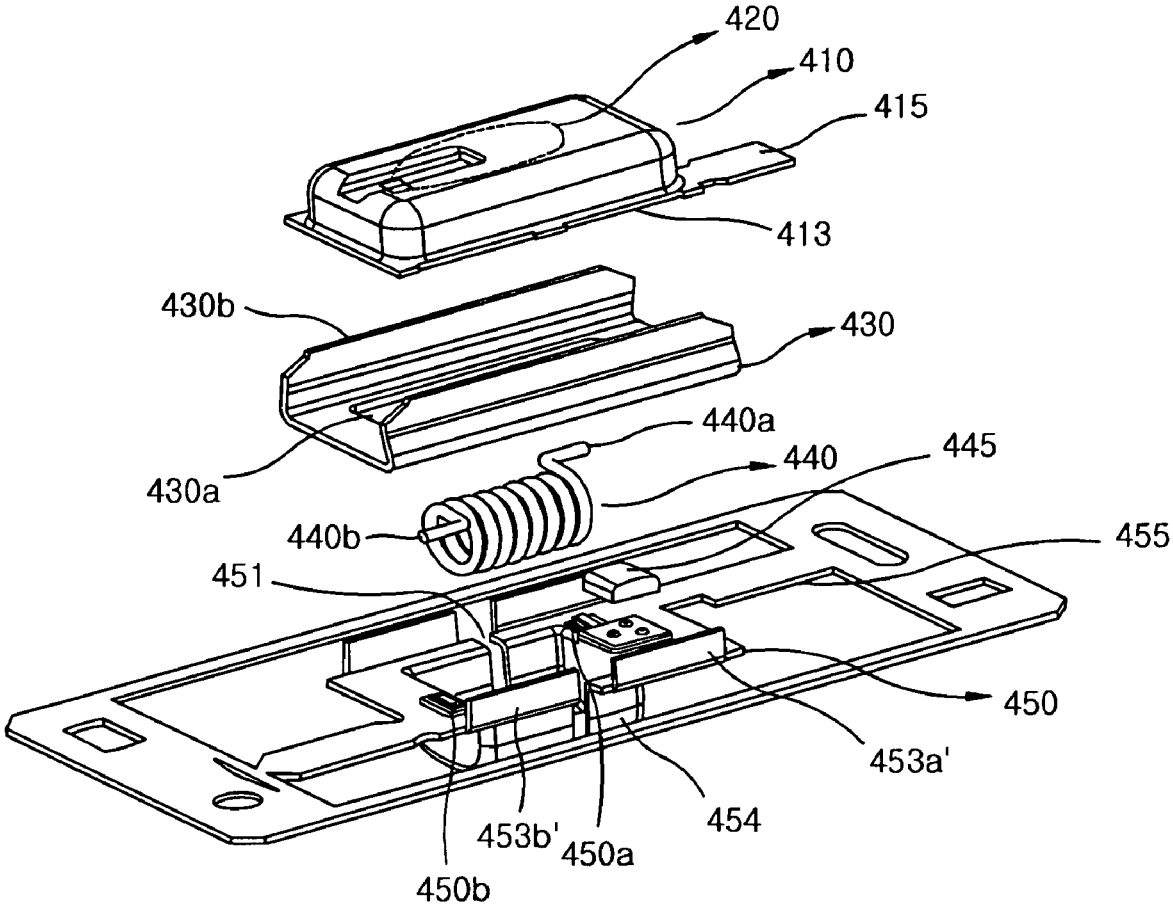
FIG. 3*b* is an exploded perspective view of a coil heater type overload protector shown in FIG. 3*a*.

The low-power overload protector 400 shown in FIGS. 3*a* and 3*b* includes a conductive housing can 410 having a bottom section, lateral sections, a flange 413 extending from the lateral sections and a connecting terminal 415 extending from one end of the conductive housing can 410, a bimetal member 420 having a first end fixed to the bottom section of the conductive housing can 410 and a second end provided with a movable contact, an insulation gasket 430 having a wing cover 430*b* surrounding the flange 413 of the conductive housing can 410 and an opening window 430*a* which is a moving path for the bimetal member 420, a plate 450 having first and second sections 453*a* and 453*b* separated from each other about a space section 451 and including a fixing contact 445, a connecting terminal 455 provided at one end of the plate 450, and clamp wings 453*a*' and 453*b*' provided at both sides of the plate 450 in order to fix the flange 413 of the conductive housing can 410 and the wing cover 430*b* of the insulation gasket 430 together, and a coil heater 440 having first and second ends 440*a* and 440*b* fixed to first and second sections 453*a* and 453*b* of the plate 450, respectively, serving as the heating element.

During a normal operation, the connecting terminal 455 provided at one end of the plate 450, the coil heater 440 connected between the first and second sections 453*a* and 453*b* of the plate 450, the fixing contact 445 of the plate 450, the bimetal member 420, and the connecting terminal 415 of the conductive housing can 410 are electrically connected through a circuit. When overload is applied, the coil heater 440 generates heat so that a reaction time of the bimetal member 420 can be shortened. At this time, the bimetal member 420 is snap-operated so that the bimetal member 420 is separated from the fixing contact. Thus, the circuit connection for the above elements is disconnected, so that power being supplied to the circuit can be shut off.

The plate 450 includes a dome-shaped receiving cavity 454 for receiving the coil heater 440.

In addition, the connecting package of the present invention may employ an overload protector different from the above coil heater type overload protector. For example, the connecting package of the present invention can employ an overload protector disclosed in U.S. patent application Ser. No. 10/727,297 entitled "low-power motor overload protector" and a continuation application thereof.

Figure 4A:
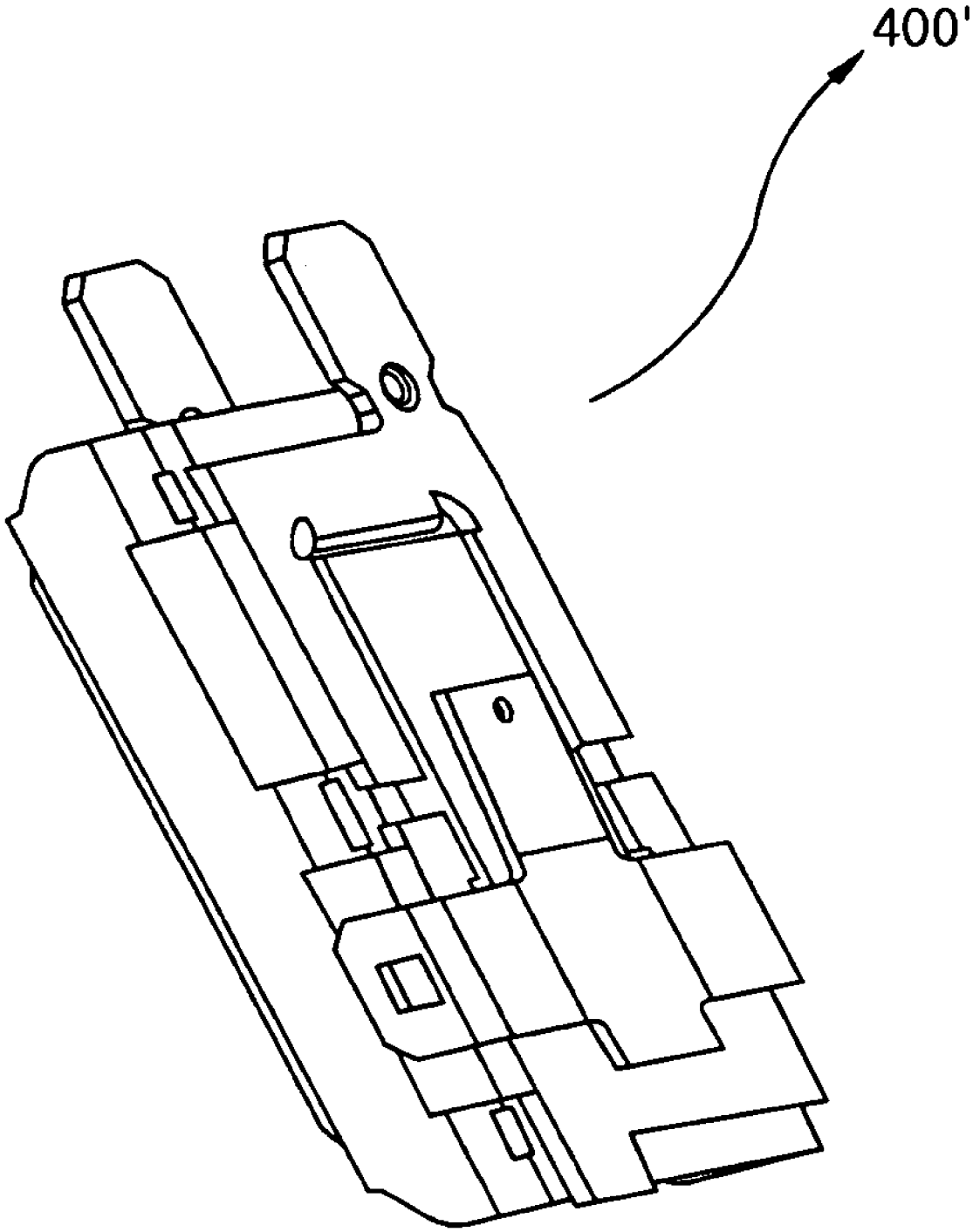
FIG. 4*a* is an exploded perspective view of a ceramic heater type overload protector mounted in a connecting package for a refrigerator compressor according to another embodiment of the present invention.
Figure 4B:
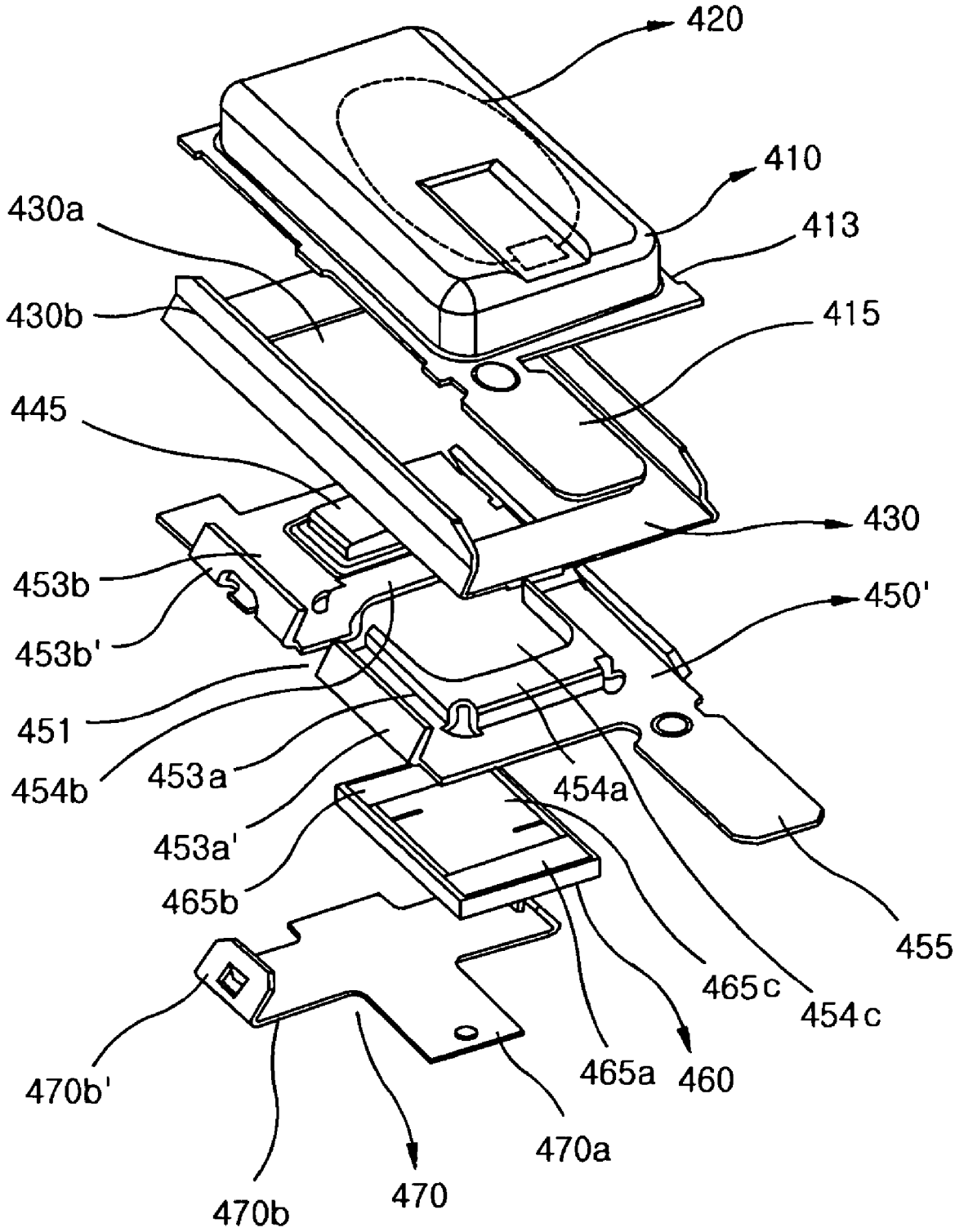
FIG. 4*b* is an exploded perspective view of a ceramic heater type overload protector shown in FIG. 4*a*.

The above low-power overload protector is shown in FIGS. 4*a* and 4*b* with reference numeral 400'.

As shown in FIGS. 4*a* and 4*b*, the low-power overload protector 400' includes a conductive housing can 410 having a bottom section, lateral sections, a flange 413 extending from the lateral sections, and a connecting terminal 415 extending from one end of the conductive housing can 410, a bimetal member 420 having a first end fixed to the bottom section of the conductive housing can 410 and a second end provided with a movable contact, an insulation gasket 430 having a wing cover 430*b* surrounding the flange 413 of the conductive housing can 410 and an opening window 430*a* which is a moving path for the bimetal member 420, a plate 450' having first and second sections 453*a* and 453*b* separated from each other about a space section 451 and including first and second protruded ledge sections 454*a* and 454*b* provided in the first and second sections 453*a* and 453*b* while forming a central hole 454*c* therebetween, a fixing contact 445, a connecting terminal 455 provided at one end of the plate 450', and clamp wings 453*a*' and 453*b*' provided at both sides of the plate 450 in order to fix the flange 413 of the conductive housing can 410 and the wing cover 430*b* of the insulation gasket 430 together, a ceramic plate heater element 460 accommodated in a recess defined by the first and second ledge sections 454*a* and 454*b*, serving as the heating element and having a ceramic substrate, electric contact sections 465*a* and 465*b* provided at both sides of the ceramic plate heater element 460 such that they make contact with the ledge sections 454*a* and 454*b* and an electric-heating film 465*c* formed between the electric contact sections 465*a* and 465*b*, and a clamp spring 470 including a longitudinal extension portion 470*a* for supporting the ceramic plate heater element 460 and a transverse extension portion 470*b* provided at both sides thereof with a clamp bending section 470*b*' fixed on the clamp wing 453*b* of the plate 450'.

During a normal operation, the connecting terminal 455 provided at one end of the plate 450', the ceramic plate heater element 460 connected between first and second ledge sections 454*a* and 454*b* of the plate 450', the fixing contact 445 of the plate 450', the bimetal member 420, and the connecting terminal 415 of the conductive housing can 410 are electrically connected through a circuit. When overload is applied, the heating film 465*c* of the ceramic plate heater element 460 generates heat so that a reaction time of the bimetal member 420 can be shortened. At this time, the bimetal member 420 is snap-operated so that the bimetal member 420 is separated from the fixing contact. Thus, the circuit connection for the above elements is disconnected, so that power being supplied to the circuit can be shut off.

The pin connector PC positioned corresponding to the third pin connecting port PC3 of the base 100 and the quick connector QC connected to an external power source are connected to both connecting terminals 425 and 455 of the above overload protectors 400 and 400', respectively.

Figure 5A:
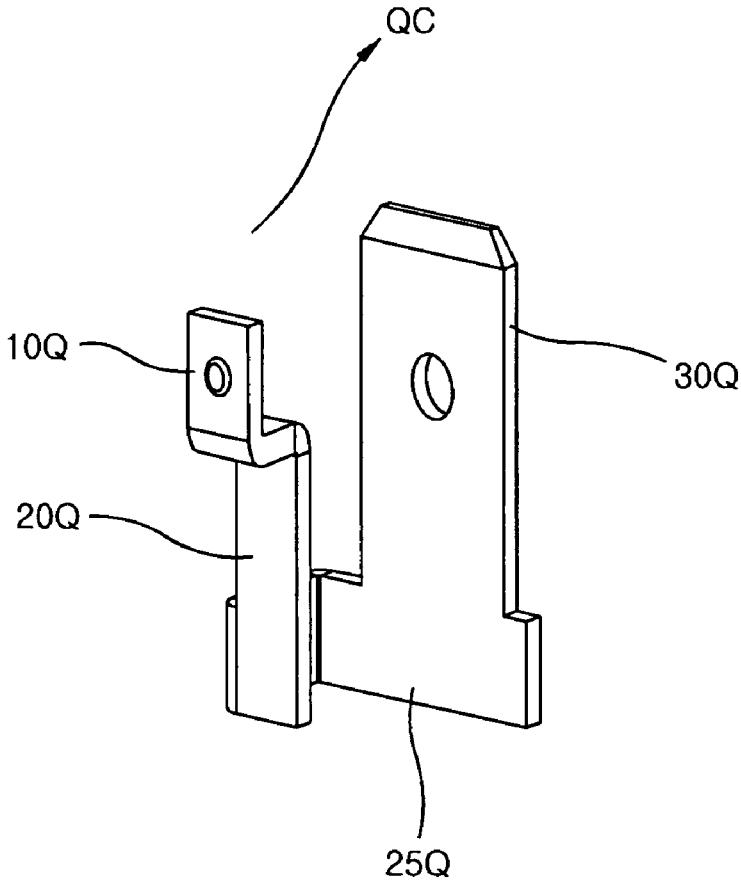
FIGS. 5*a* and 5*b* are perspective views illustrating a quick connector and a pin connector connected to connecting terminals of an overload protector shown in FIG. 3*a* or 4*a* according to one embodiment of the present invention.
Figure 5B:
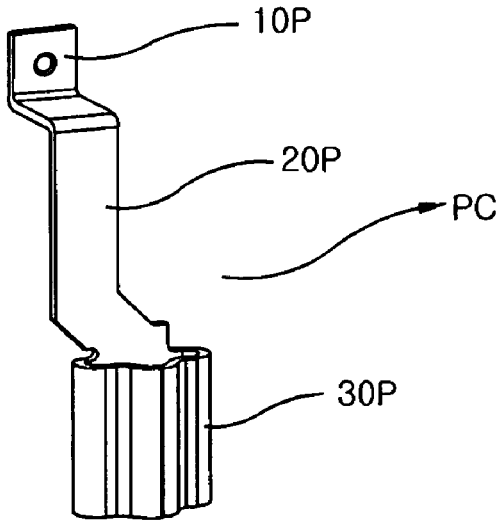

Structures of the quick connector QC and the pin connector PC are shown in FIGS. 5*a* and 5*b*.

Referring to FIGS. 5*a* and 5*b*, the quick connector QC includes a fixing section 10Q fixed to the connecting terminal (for example, the connecting terminal 455) of the overload protector, a downward extension section 20Q, a quick terminal 30Q, and a connecting section 25Q for connecting the downward extension section 20Q to a lower portion of the quick terminal 30Q.

In addition, the pin connector PC includes a fixing section 10P fixed to the connecting terminal (for example, the connecting terminal 415) of the overload protector, a downward extension section 20P, and a pin terminal 30P.

Such pin connector and the quick connector are connected to the connecting terminals of the overload protector, so structures of the pin connector and the quick connector may vary depending on the position of the overload protector and the direction of the connecting terminals. If the structures of the pin connector and the quick connector are changed, the receiving section of the base for the pin connector and the quick connector is also changed corresponding to the structures of the pin connector and the quick connector.

Figure 6A:
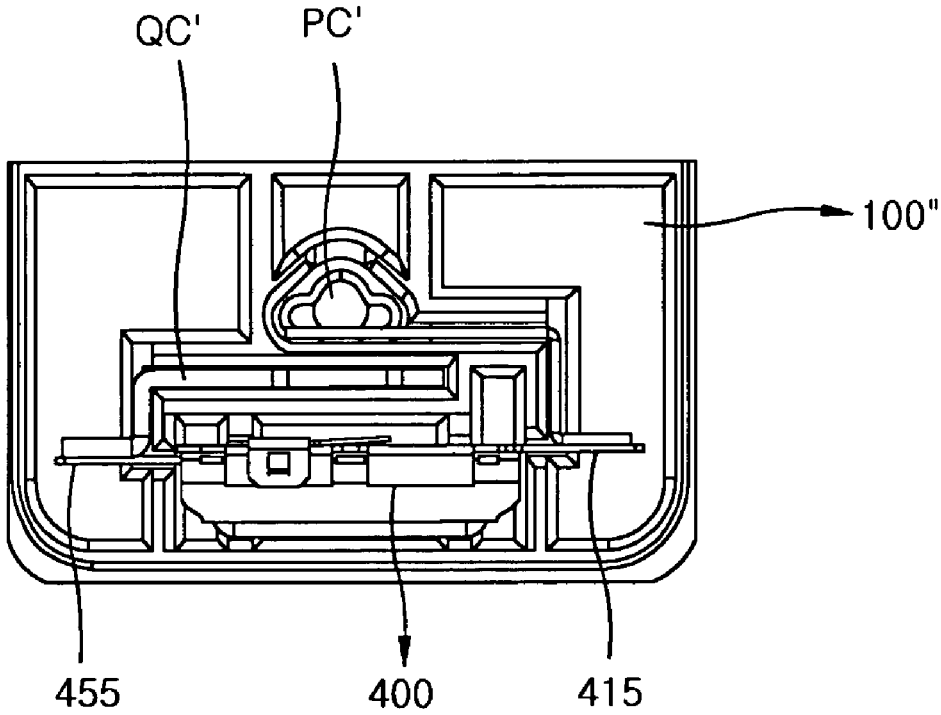
FIGS. 6*a* to 6*c* are views illustrating structures of a quick connector and a pin connector according to the position of a connecting terminal of an overload protector, and a structure of a receiving section of a base for the quick connector and the pin connector corresponding to the structures of the quick connector and the pin connector.
Figure 6B:
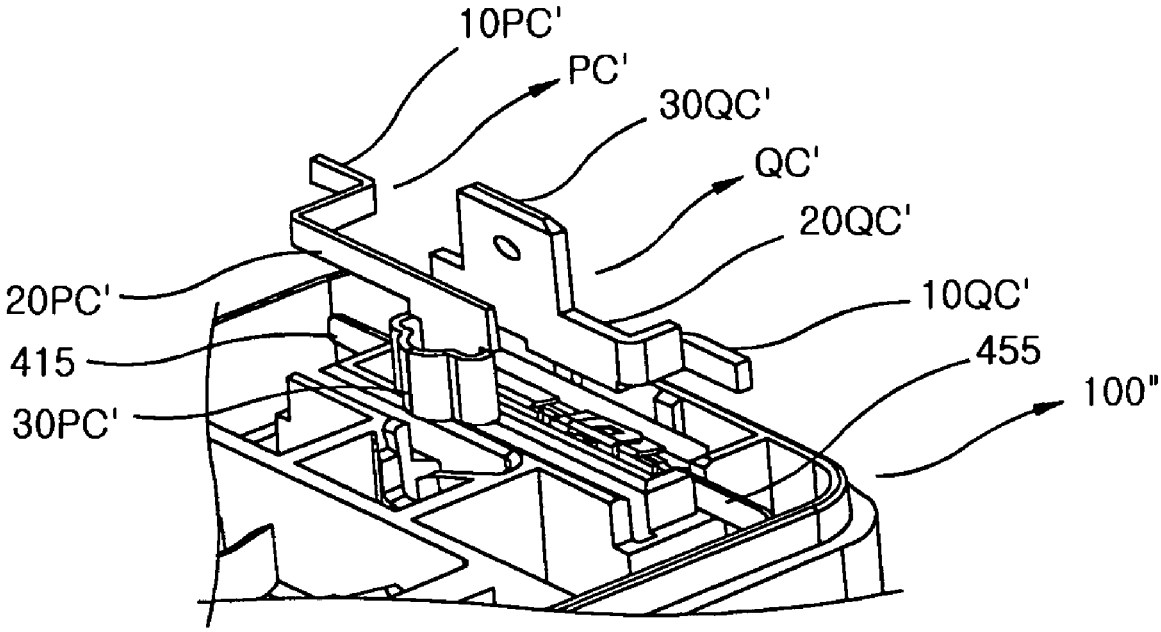
Figure 6C:
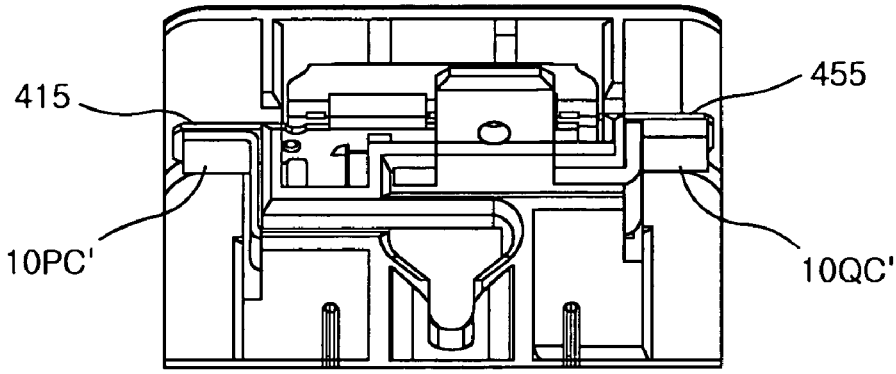

FIGS. 6*a* to 6*c* shows structures of the quick connector and the pin connector according to the position of the connecting terminal of the overload protector, and the structure of the receiving section of the base for the quick connector and the pin connector corresponding to the structures of the quick connector and the pin connector.

Referring to FIGS. 6*a* to 6*c*, a pin connector PC' includes a fixing section 10PC' fixed to the connecting terminal (for example, the connecting terminal 415) of the overload protector, a horizontal extension section 20PC', and a pin terminal 30PC'. The pin connector PC' is substantially identical to the pin connector PC shown in FIG. 5*b* except for the horizontal extension section 20PC'.

In addition, a quick connector QC' includes a fixing section 10QC' fixed to the connecting terminal (for example, the connecting terminal 455) of the overload protector, a horizontal extension section 20QC', and a quick terminal 30QC'. The quick connector QC' is substantially identical to the quick connector QC shown in FIG. 5*a* except for the horizontal extension section 20QC', which may act as the connecting section 25Q of the quick connector shown in FIG. 5*a*.

A structure of a receiving section of a base 100" for receiving the pin connector PC' and the quick connector QC' must be changed corresponding to the structures of the pin connector PC' and the quick connector QC'.

Figure 2A:
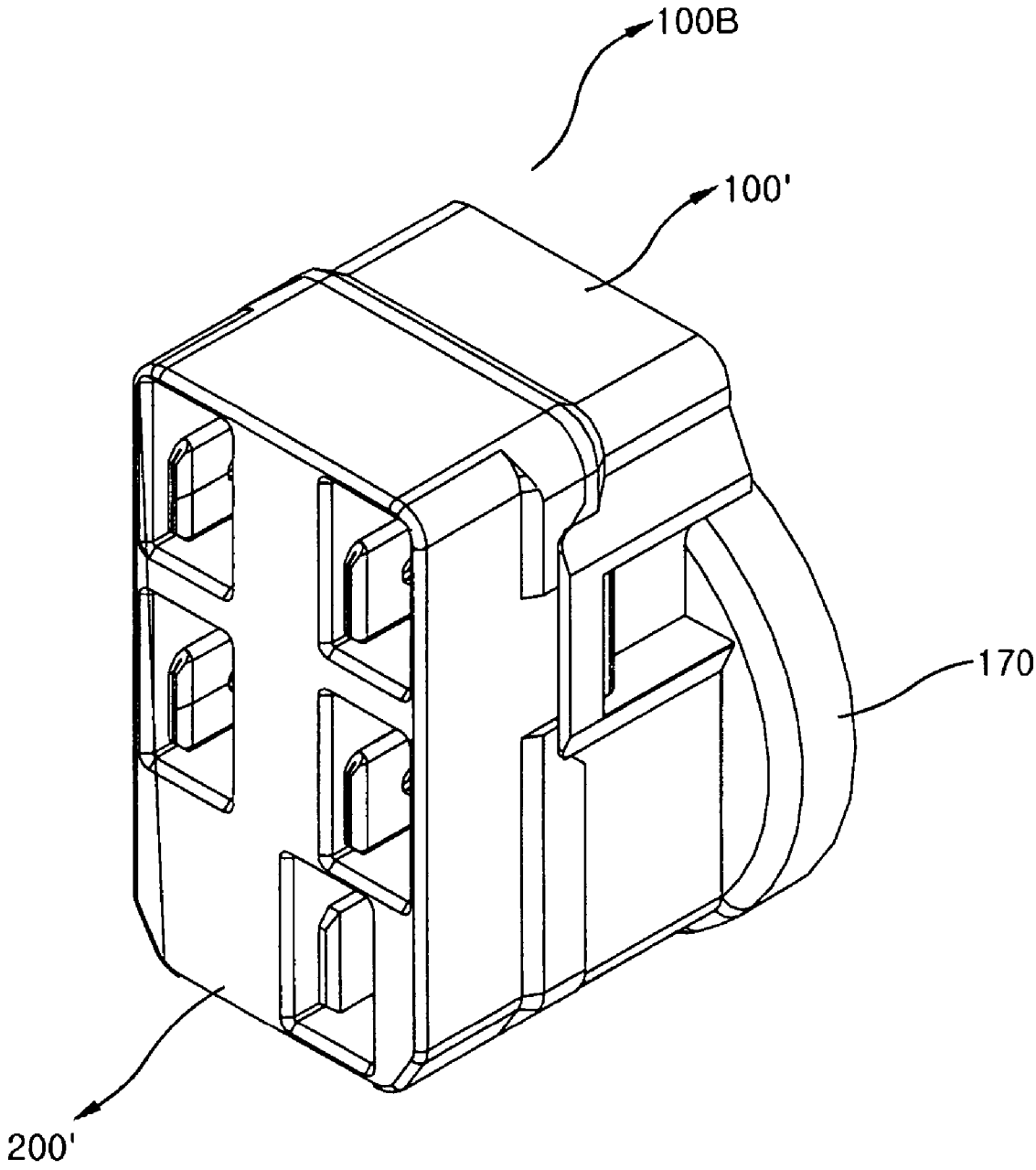
FIG. 2*a* is a perspective view of a connecting package for a refrigerator compressor according to another embodiment of the present invention.
Figure 2B:
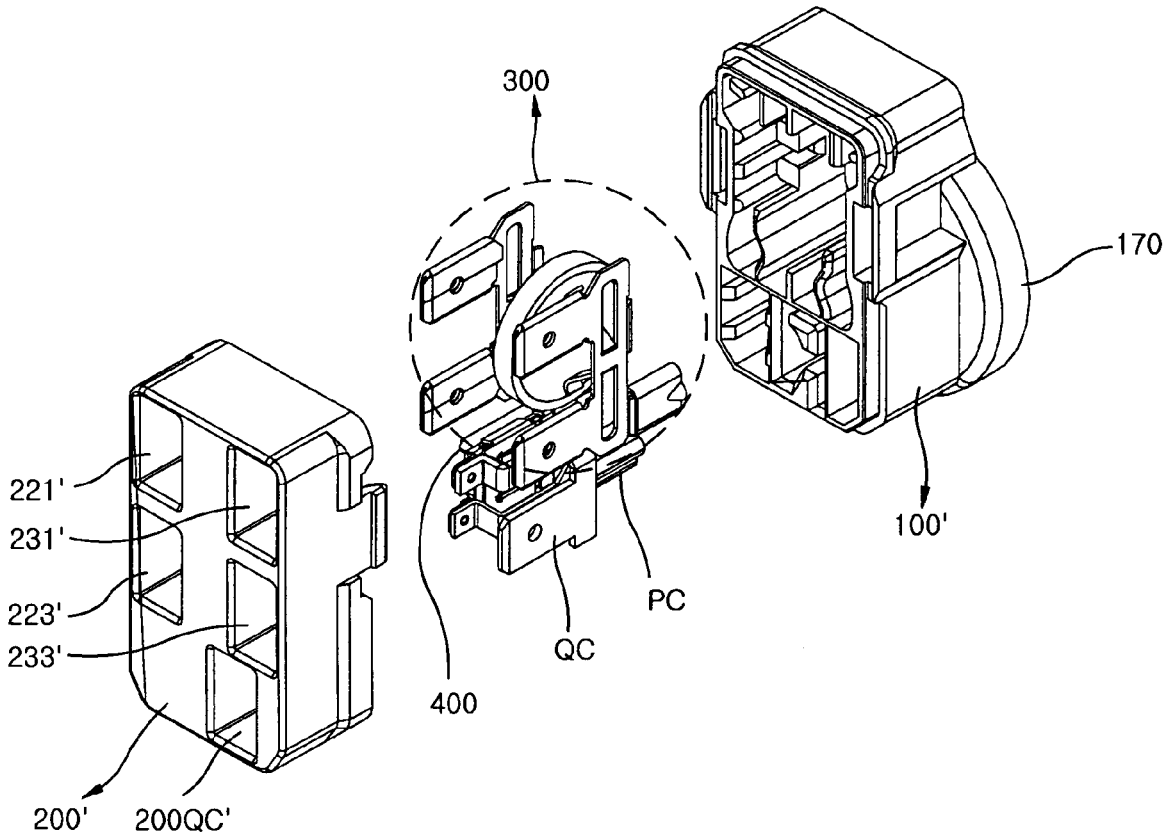
FIG. 2*b* is an exploded perspective view of a connecting package shown in FIG. 2*a*.
Figure 2C:
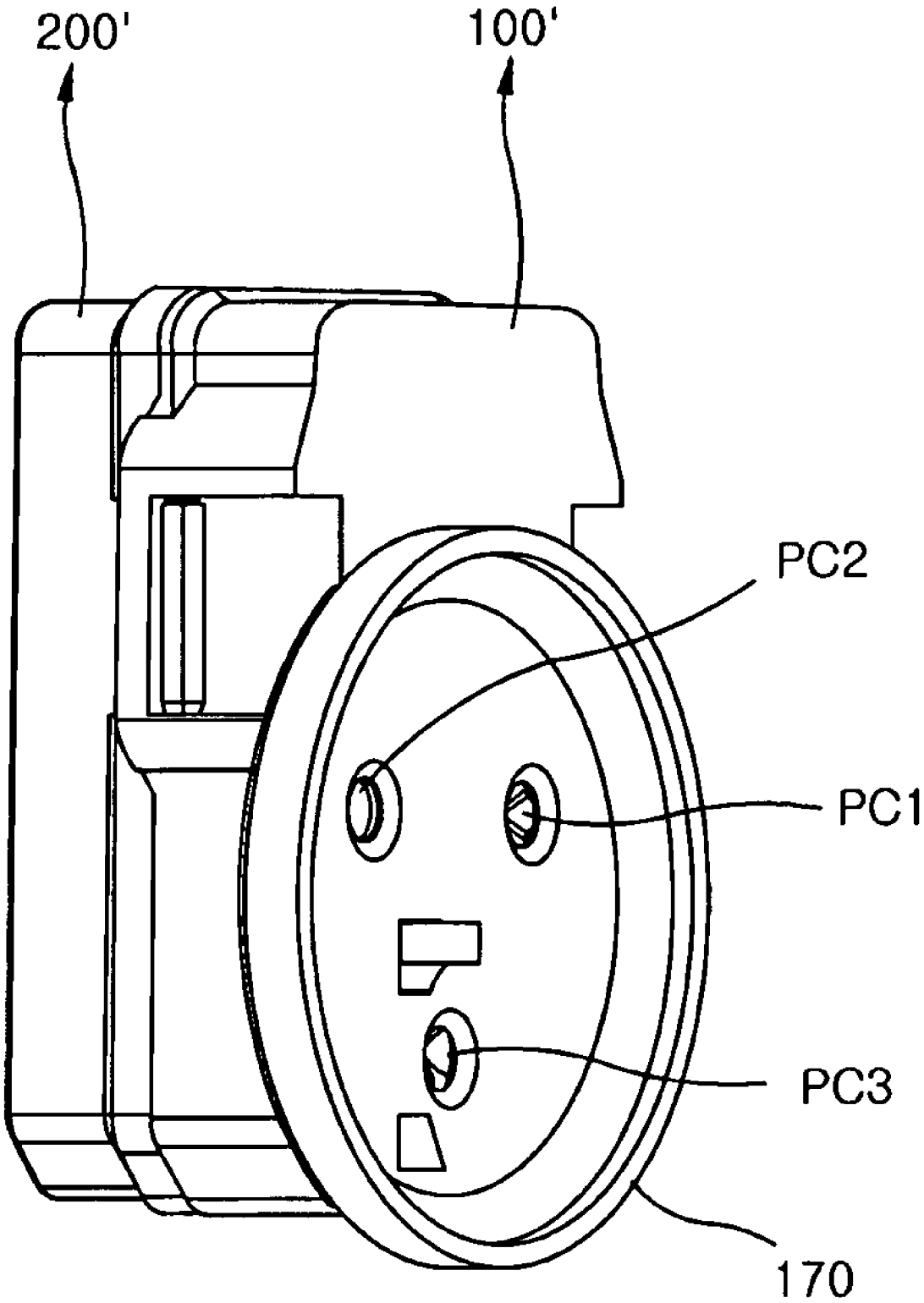
FIG. 2*c* is a perspective view of a connecting package for a refrigerator compressor shown in FIG. 2*a* when it is viewed from a base.

According to another embodiment of the present invention, it is also possible to change the structures of the base and the cover of the connecting package as shown in FIGS. 2*a* to 2*c*.

As shown in FIGS. 2*a* to 2*c*, a connecting package 100B is substantially identical to the connecting package 100A shown in FIG. 1*a* to 1*e*, except for structures of the cover and the base.

Differently from the cover 200 of the connecting package 200A shown in FIG. 1*a* to 1*e*, a cover 200' of the connecting package 100B further includes protective guides for protecting connecting terminals 321, 323, 331 and 333 protruding through slots 221, 231, 233 and 200QC so that the slots 221, 231, 233 and 200QC are protected by means of slot protecting channels 221', 231', 233' and 200QC'.

In addition, the base 100' of the connecting package 100B further includes a circular terminal shielding cover 170 formed at a lower portion of the base 100' in order to protect the circular terminal when the connecting package 100B is connected to the circular terminal provided on the body of the refrigerator compressor.

Accordingly, moisture or impurities are prevented from penetrating into the circular terminal provided on the body of the refrigerator compressor by means of the circular terminal shielding cover 170, thereby ensuring stability of the connecting package and safety of workers.

It is preferable that a flange 100'*a* is formed on an outer side of an upper edge of the base 100' so as to ensure a water injection insulation or keep foreign substances from entering the connecting package 100B (refer to FIG. 2*a* and FIG. 2*b*).

According to another embodiment of the present invention, the base 100 or 100' of the connecting package 100A or 100B can be assembled with the cover 200 or 200' of the connecting package 100A or 100B.

For instance, the cover 200' or the base 100' of the connecting package 100B shown in FIGS. 2*a* to 2*c* can be used for the connecting package 100A shown in FIGS. 1*a* to 1*e*.

Figure 7:
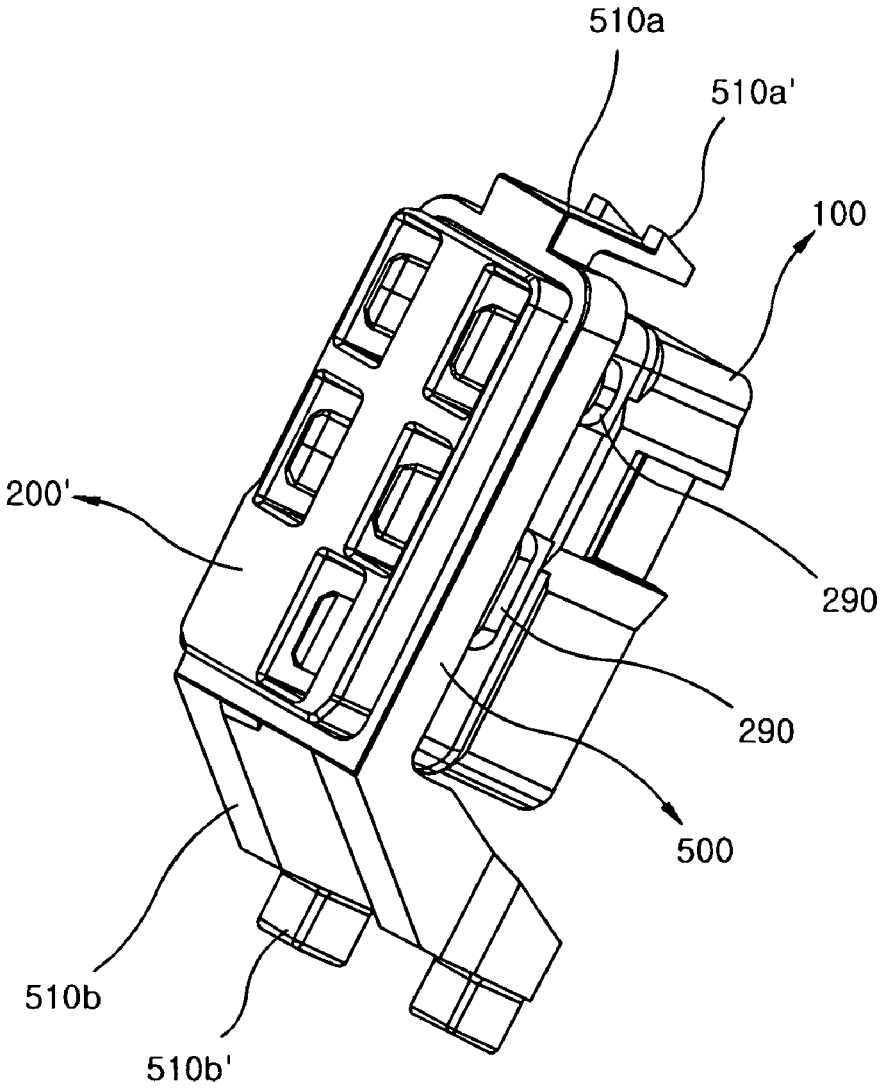
FIG. 7 is a perspective view illustrating of a connecting package, in which a detachable clamp is additionally installed on the connecting package in order to fix the connecting package to a body of a refrigerator compressor.

In the meantime, as shown in FIG. 7, a detachable clamp can be additionally provided on an outer surface of the connecting package 100A or 100B of the present invention. That is, the detachable clamp is provided on an outer surface of the cover so as to detachably couple the connecting package for the refrigerator compressor to a coupling section of the body of the refrigerator compressor, for example, to a vertical wall fence having a hole.

Such a detachable clamp 500 includes a rim member disposed around an assembly of the base 100 and the cover 200' and downward extension sections 510*a* and 510*b* provided at both ends of the rim member. The downward extension sections 510*a* and 510*b* are provided at end portions thereof with coupling protrusions 510*a*' and 510*b*' so as to allow the detachable clamp 500 to be coupled with the coupling section of the compressor body. That is, the coupling protrusions 510*a*' and 510*b*' are inserted into the hole of the vertical wall fence.

The detachable clamp 500 can be further provided at an end of the rim member with a shielding roof, which shields an external connecting terminal slot when the detachable clamp 500 is coupled with the connecting package, thereby preventing moisture from penetrating into the external connecting terminal slot.

If the connecting package is equipped with the detachable clamp 500, an earlobe 290 can be provided at an outer surface of the cover as a stopper for limiting the movement of the detachable clamp 500.

It is also possible to integrally from the downward extension section with the outer surface of the cover without using the detachable clamp 500. Such a structure is generally known in the art.

According to the connecting package employing the detachable clamp or the integral clamp of the present invention, the covers and the bases according to various embodiments of the present invention can be assembled with each other in use.

As mentioned above, according to the connecting package for the refrigerator compressor of the present invention, an electric connection for various elements is easily achieved through one package in such a manner that a motor can be protected from overload when an operation of the refrigerator compressor starts while improving an operating efficiency of the motor, moisture including water or rainwater can be prevented from penetrating into a connection part when the connecting package is coupled with the refrigerator compressor while reducing an influence of load generated when coupling the connecting package with the refrigerator compressor, and the connecting package can be stably connected to the body of the refrigerator compressor, thereby stably operating the refrigerator compressor.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A connecting package for a refrigerator compressor, the connecting package comprising:

a base including an overload protector mounting section and a motor starter relay element mounting section and having first to third pin connecting ports connected to a compressor motor through a circular terminal of a compressor body;

a cover detachably coupled to an upper portion of the base, including a dome-shaped overload protector mounting section and a dome-shaped motor starter relay element mounting section corresponding to the overload protector mounting section and the motor starter relay element mounting section of the base, and having a plurality of slots for connecting terminals formed around the dome-shaped overload protector mounting section and the dome-shaped motor starter relay element mounting section;

a motor starter relay element mounted in the motor starter relay element mounting sections of the base and the cover and having first and second pin connectors positioned corresponding to the first and second pin connecting ports of the base; and a low-power overload protector mounted in the overload protector mounting sections of the base and the cover and having a first connecting terminal connected to a pin connector positioned corresponding to the third pin connecting port of the base, a second connecting terminal connected to a quick connector connected to an external power source, and a heating element for shortening a reaction time of the low-power overload protector.

2. The connecting package as claimed in claim 1, wherein the cover is provided at both sides thereof with a downward extension section having a coupling protrusion, and the base is formed at both sides thereof with a coupling slot detachably coupled with the coupling protrusion of the cover such that the base is detachably coupled to the cover.

3. The connecting package as claimed in claim 1, further comprising protective guides aligned around the slots of the cover so as to protect the connecting terminals protruding through the slots.

4. The connecting package as claimed in claim 1, further comprising a circular terminal shielding cover formed at a lower portion of the base in order to protect the circular terminal formed in the body of the refrigerator compressor when the connecting package is connected to the circular terminal formed in the body of the refrigerator compressor.

5. The connecting package as claimed in claim 3, further comprising a circular terminal shielding cover formed at a lower portion of the base in order to protect the circular terminal formed in the body of the refrigerator compressor when the connecting package is connected to the circular terminal formed in the body of the refrigerator compressor.

6. The connecting package as claimed in claim 1, wherein an earlobe is formed at an outer surface of the cover as a stopper and a detachable clamp is provided on an outer surface of the connecting package so as to detachably couple the connecting package to the body of the refrigerator compressor, the detachable clamp being supported by the earlobe and including a rim member disposed around a cover-base assembly and downward extension sections provided at both ends of the rim member, the downward extension sections being provided at end portions thereof with coupling protrusions so as to allow the detachable clamp to be coupled with the compressor body.

7. The connecting package as claimed in claim 3, wherein an earlobe is formed at an outer surface of the cover as a stopper and a detachable clamp is provided on an outer surface of the connecting package so as to detachably couple the connecting package to the body of the refrigerator compressor, the detachable clamp being supported by the earlobe and including a rim member disposed around a cover-base assembly and downward extension sections provided at both ends of the rim member, the downward extension sections being provided at end portions thereof with coupling protrusions so as to allow the detachable clamp to be coupled with the compressor body.

8. The connecting package as claimed in claim 4, wherein an earlobe is formed at an outer surface of the cover as a stopper and a detachable clamp is provided on an outer surface of the connecting package so as to detachably couple the connecting package to the body of the refrigerator compressor, the detachable clamp being supported by the earlobe and including a rim member disposed around a cover-base assembly and downward extension sections provided at both ends of the rim member, the downward extension sections being provided at end portions thereof with coupling protrusions so as to allow the detachable clamp to be coupled with the compressor body.

9. The connecting package as claimed in claim 5, wherein an earlobe is formed at an outer surface of the cover as a stopper and a detachable clamp is provided on an outer surface of the connecting package so as to detachably couple the connecting package to the body of the refrigerator compressor, the detachable clamp being supported by the earlobe and including a rim member disposed around a cover-base assembly and downward extension sections provided at both ends of the rim member, the downward extension sections being provided at end portions thereof with coupling protrusions so as to allow the detachable clamp to be coupled with the compressor body.

10. The connecting package as claimed in claim 6, wherein the detachable clamp further includes a shielding roof provided at an end of the rim member so as to shield an external connecting terminal slot of the cover when the detachable clamp is coupled with the connecting package, thereby preventing moisture from penetrating into the external connecting terminal slot.

11. The connecting package as claimed in claim 1, further comprising a downward extension section integrally formed with an outer surface of the cover so as to detachably couple the connecting package to the compressor body.

12. The connecting package as claimed in claim 3, further comprising a downward extension section integrally formed with an outer surface of the cover so as to detachably couple the connecting package to the compressor body.

13. The connecting package as claimed in claim 4, further comprising a downward extension section integrally formed with an outer surface of the cover so as to detachably couple the connecting package to the compressor body.

14. The connecting package as claimed in claim 5, further comprising a downward extension section integrally formed with an outer surface of the cover so as to detachably couple the connecting package to the compressor body.

15. The connecting package as claimed in claim 1, wherein one of the first and second pin connectors of the motor starter relay element and another pin connector connected to the first connecting terminal of the overload protector are connected to a main winding section of a motor, the other one of the first and second pin connectors of the motor starter relay element is connected to an auxiliary winding section of the motor, and one of the first and second pin connectors connected to the main winding section of the motor is provided with a connecting terminal connected to an external power source through the slots formed in the cover.

16. The connecting package as claimed in claim 1, wherein the low-power overload protector includes a conductive housing can having a bottom section, lateral sections, a flange extending from the lateral sections and a connecting terminal extending from one end of the conductive housing can; a bimetal member having a first end fixed to the bottom section of the conductive housing can and a second end provided with a movable contact; an insulation gasket having a wing cover surrounding the flange of the conductive housing can and an opening window which is a moving path for the bimetal member; a plate having first and second sections separated from each other and including a fixing contact, a connecting terminal provided at one end of the plate, and clamp wings provided at both sides of the plate in order to fix the flange of the conductive housing can and the wing cover of the insulation gasket together; and a coil heater having first and second ends fixed to first and second sections of the plate, respectively, serving as the heating element.

17. The connecting package as claimed in claim 3, wherein the low-power overload protector includes a conductive housing can having a bottom section, lateral sections, a flange extending from the lateral sections and a connecting terminal extending from one end of the conductive housing can; a bimetal member having a first end fixed to the bottom section of the conductive housing can and a second end provided with a movable contact; an insulation gasket having a wing cover surrounding the flange of the conductive housing can and an opening window which is a moving path for the bimetal member; a plate having first and second sections separated from each other and including a fixing contact, a connecting terminal provided at one end of the plate, and clamp wings provided at both sides of the plate in order to fix the flange of the conductive housing can and the wing cover of the insulation gasket together; and a coil heater having first and second ends fixed to first and second sections of the plate, respectively, serving as the heating element.

18. The connecting package as claimed in claim 4, wherein the low-power overload protector includes a conductive housing can having a bottom section, lateral sections, a flange extending from the lateral sections and a connecting terminal extending from one end of the conductive housing can; a bimetal member having a first end fixed to the bottom section of the conductive housing can and a second end provided with a movable contact; an insulation gasket having a wing cover surrounding the flange of the conductive housing can and an opening window which is a moving path for the bimetal member; a plate having first and second sections separated from each other and including a fixing contact, a connecting terminal provided at one end of the plate, and clamp wings provided at both sides of the plate in order to fix the flange of the conductive housing can and the wing cover of the insulation gasket together; and a coil heater having first and second ends fixed to first and second sections of the plate, respectively, serving as the heating element.

19. The connecting package as claimed in claim 5, wherein the low-power overload protector includes a conductive housing can having a bottom section, lateral sections, a flange extending from the lateral sections and a connecting terminal extending from one end of the conductive housing can; a bimetal member having a first end fixed to the bottom section of the conductive housing can and a second end provided with a movable contact; an insulation gasket having a wing cover surrounding the flange of the conductive housing can and an opening window which is a moving path for the bimetal member; a plate having first and second sections separated from each other and including a fixing contact, a connecting terminal provided at one end of the plate, and clamp wings provided at both sides of the plate in order to fix the flange of the conductive housing can and the wing cover of the insulation gasket together; and a coil heater having first and second ends fixed to first and second sections of the plate, respectively, serving as the heating element.

20. The connecting package as claimed in claim 1, wherein the low-power overload protector includes a conductive housing can having a bottom section, lateral sections, a flange extending from the lateral sections and a connecting terminal extending from one end of the conductive housing can; a bimetal member having a first end fixed to the bottom section of the conductive housing can and a second end provided with a movable contact; an insulation gasket having a wing cover surrounding the flange of the conductive housing can and an opening window which is a moving path for the bimetal member; a plate having first and second sections separated from each other and including first and second protruded ledge sections provided in the first and second sections while forming a central hole therebetween, a fixing contact, a connecting terminal provided at one end of the plate, and clamp wings provided at both sides of the plate in order to fix the flange of the conductive housing can and the wing cover of the insulation gasket together; a ceramic plate heater element accommodated in a recess defined by the first and second ledge sections, serving as the heating element and having a ceramic substrate, electric contact sections provided at both sides of the ceramic plate heater element such that electric contact sections make contact with the ledge sections and an electric-heating film formed between the electric contact sections; and a clamp spring including a longitudinal extension portion for supporting the ceramic plate heater element and a transverse extension portion provided at both sides thereof with a clamp bending section fixed on the clamp wing of the plate.

21. The connecting package as claimed in claim 3, wherein the low-power overload protector includes a conductive housing can having a bottom section, lateral sections, a flange extending from the lateral sections and a connecting terminal extending from one end of the conductive housing can; a bimetal member having a first end fixed to the bottom section of the conductive housing can and a second end provided with a movable contact; an insulation gasket having a wing cover surrounding the flange of the conductive housing can and an opening window which is a moving path for the bimetal member; a plate having first and second sections separated from each other and including first and second protruded ledge sections provided in the first and second sections while forming a central hole therebetween, a fixing contact, a connecting terminal provided at one end of the plate, and clamp wings provided at both sides of the plate in order to fix the flange of the conductive housing can and the wing cover of the insulation gasket together; a ceramic plate heater element accommodated in a recess defined by the first and second ledge sections, serving as the heating element and having a ceramic substrate, electric contact sections provided at both sides of the ceramic plate heater element such that electric contact sections make contact with the ledge sections and an electric-heating film formed between the electric contact sections; and a clamp spring including a longitudinal extension portion for supporting the ceramic plate heater element and a transverse extension portion provided at both sides thereof with a clamp bending section fixed on the clamp wing of the plate.

22. The connecting package as claimed in claim 4, wherein the low-power overload protector includes a conductive housing can having a bottom section, lateral sections, a flange extending from the lateral sections and a connecting terminal extending from one end of the conductive housing can; a bimetal member having a first end fixed to the bottom section of the conductive housing can and a second end provided with a movable contact; an insulation gasket having a wing cover surrounding the flange of the conductive housing can and an opening window which is a moving path for the bimetal member; a plate having first and second sections separated from each other and including first and second protruded ledge sections provided in the first and second sections while forming a central hole therebetween, a fixing contact, a connecting terminal provided at one end of the plate, and clamp wings provided at both sides of the plate in order to fix the flange of the conductive housing can and the wing cover of the insulation gasket together; a ceramic plate heater element accommodated in a recess defined by the first and second ledge sections, serving as the heating element and having a ceramic substrate, electric contact sections provided at both sides of the ceramic plate heater element such that electric contact sections make contact with the ledge sections and an electric-heating film formed between the electric contact sections; and a clamp spring including a longitudinal extension portion for supporting the ceramic plate heater element and a transverse extension portion provided at both sides thereof with a clamp bending section fixed on the clamp wing of the plate.

23. The connecting package as claimed in claim 5, wherein the low-power overload protector includes a conductive housing can having a bottom section, lateral sections, a flange extending from the lateral sections and a connecting terminal extending from one end of the conductive housing can; a bimetal member having a first end fixed to the bottom section of the conductive housing can and a second end provided with a movable contact; an insulation gasket having a wing cover surrounding the flange of the conductive housing can and an opening window which is a moving path for the bimetal member; a plate having first and second sections separated from each other and including first and second protruded ledge sections provided in the first and second sections while forming a central hole therebetween, a fixing contact, a connecting terminal provided at one end of the plate, and clamp wings provided at both sides of the plate in order to fix the flange of the conductive housing can and the wing cover of the insulation gasket together; a ceramic plate heater element accommodated in a recess defined by the first and second ledge sections, serving as the heating element and having a ceramic substrate, electric contact sections provided at both sides of the ceramic plate heater element such that electric contact sections make contact with the ledge sections and an electric-heating film formed between the electric contact sections; and a clamp spring including a longitudinal extension portion for supporting the ceramic plate heater element and a transverse extension portion provided at both sides thereof with a clamp bending section fixed on the clamp wing of the plate.

24. The connecting package as claimed in claim 1, wherein at least two ribs are formed on one inner wall of the overload protector mounting section of the base.

25. The connecting package as claimed in claim 1, wherein a flange is formed on an outer side of an upper edge of the base.

26. The connecting package as claimed in claim 1, wherein ribs are formed on an inner wall of the motor starter relay element mounting section of the base outwards in a radial direction of a PTC starter element of the motor starter relay element so as to support the PTC starter element with the ribs facing each other.

27. The connecting package as claimed in claim 15, wherein each of the first and second pin connectors has a pin receptacle for detachably fixing a corresponding pin to the pin receptacle.

28. The connecting package as claimed in claim 26, wherein the motor starter relay element mounting section is provided with conductive plates arranged in an axial direction of the PTC starter element so that the conductive plates face both sides of the PTC starter element, respectively, and at least two elastic connecting members are provided on one side of each of the conductive plates so as to elastically support a facing side of the PTC starter element.

* * * * *